US006772560B2

(12) United States Patent
Dischiant et al.

(10) Patent No.: US 6,772,560 B2
(45) Date of Patent: Aug. 10, 2004

(54) WEATHER STRIP FOR DOORS

(76) Inventors: Greg Dischiant, 321 W. Douglassville Rd., Nazareth, PA (US) 18064; Mark Keppel, 228 Stomy Run Rd., Spring City, PA (US) 19475-2411

( * ) Notice: Subject to any disclaimer, the term of this patent is extended or adjusted under 35 U.S.C. 154(b) by 0 days.

(21) Appl. No.: 10/277,415

(22) Filed: Oct. 22, 2002

(65) Prior Publication Data

US 2003/0074843 A1 Apr. 24, 2003

Related U.S. Application Data

(60) Provisional application No. 60/336,062, filed on Oct. 23, 2001.

(51) Int. Cl.[7] ..... E06B 7/232
(52) U.S. Cl. ..... 49/496.1; 49/197
(58) Field of Search ..... 49/197, 475.1, 49/496.1

(56) References Cited

U.S. PATENT DOCUMENTS

| | | | | |
|---|---|---|---|---|
| 1,728,120 A | * | 9/1929 | Greene | 49/197 |
| 2,866,237 A | * | 12/1958 | May | 49/496.1 |
| 3,411,243 A | | 11/1968 | Baermann | |
| 4,096,665 A | | 6/1978 | Ellingson | |
| 4,237,630 A | * | 12/1980 | Franzone | 40/152 |
| 5,009,036 A | | 4/1991 | Ryan | |
| 5,092,079 A | | 3/1992 | Brookman et al. | |
| 5,214,880 A | | 6/1993 | Woodruff et al. | |
| 5,216,839 A | | 6/1993 | Woodruff | |
| 5,230,180 A | | 7/1993 | Tweedt et al. | |
| 5,435,104 A | * | 7/1995 | Dietrich | 49/496.1 |
| 5,784,834 A | | 7/1998 | Stutzman | |
| 5,953,001 A | * | 9/1999 | Challener et al. | 345/179 |
| 6,167,657 B1 | | 1/2001 | Burge et al. | |
| 6,273,175 B1 | * | 8/2001 | Kellogg et al. | 160/205 |

FOREIGN PATENT DOCUMENTS

| | | |
|---|---|---|
| CA | 728935 | 3/1966 |
| DE | 3315091 | 8/1984 |
| FR | 2308775 | 11/1976 |
| GB | 1241669 | 8/1971 |
| GB | 2153890 | 8/1985 |
| GB | 2231361 | 11/1990 |

* cited by examiner

*Primary Examiner*—Jerry Redman
(74) *Attorney, Agent, or Firm*—Harding, Earley, Follmer & Frailey; John F.A. Earley; John F.A. Earley, III

(57) ABSTRACT

A sealing device for a door, and in particular for a garage door, for sealing the door and frame to facilitate the exclusion of elements, such as, for example, draughts, wind, rain, snow, insects, and the like, with a first part or base provided for mounting to a supporting surface, and a second part constructed to attach to the first part, the second part carrying a sealing element.

16 Claims, 3 Drawing Sheets

WEATHER STRIP FOR DOORS

CROSS-REFERENCE TO RELATED APPLICATION

This Application claims priority to Provisional Application Serial No. 60/336,062 filed on Oct. 23, 2001.

BACKGROUND OF THE INVENTION

1. Field of the Invention

This invention relates to the field of seals which mount on a door frame to seal between the door and the frame and, in particular, to seal around the perimeter of overhead garage doors.

2. Brief Description of the Related Art

It is known to provide seals around the perimeter or edge of a door in order to seal out elements, such as for example, air drafts, rain, snow, insects and dust. Most seals are utilized in connection with a door or door frame. There are some seals which are mounted directly on the door. Generally, such seals are mounted on the bottom of the door to maintain a seal with the ground or door sill when the door is closed. Other seals are provided on the door frame, and are configured to seal the door against air drafts, insects, water, and other elements.

It is known to provide seals for garage doors. Generally, for the most part, garage doors are larger in perimeter than most entry doors. A seal is desirable to be maintained between the door panel and the door frame. Since there is usually some space between the frame and the door, it is desirable to seal that space. Attempts have been made to provide a seal or weather strip for garage doors. These prior seals include strips with a flexible seal which are nailed to a door frame, such as the "Door Seal" disclosed in U.S. Pat. No. 5,784,834 issued on Jul. 28, 1998 to Ellis D. Stutzman. Another example of a door seal is found in U.S. Pat. No. 6,167,657 for a "Weatherstrip Product Formed by Sequential Extrusion of Cellular and Non-Cellular Plastic Resins" issued on Jan. 2, 2001 to Gary Burge, et al. U.S. Pat. No. 5,092,079, issued on Mar. 3, 1992 to Marc A. Brookman, et al., discloses a "Weather Seal for a Garage Door" with a block which pivotally moves in relation to a base member. A "Door Having Hidden Screw Construction" is disclosed in U.S. Pat. No. 5,230,180, issued on Jul. 27, 1993 to Robert C. Tweedt, which provides a plastic edge cap on the latch edge of the door.

Great Britain patent application no. 2 153 890 A published on Aug. 29, 1985 discloses a "Weather Seal" for a door or window which has a channel-shaped base member and a cover member pivotally attached to the base member by means of a flexible web. Canadian patent application 728, 935 provides a soft material which mounts on an attachment member. Great Britain patent application 2 231 361 A published on Nov. 14, 1990, discloses "Draught seals for doors", where a spring and brush are provided and first strip is arranged for sliding attachment to another strip.

A need exists for a weather sealing device which is economical to produce and assemble, and which can be easily installed on a frame of a door, such as, for example, a garage door, and replaced when necessary (i.e., when damaged).

SUMMARY OF THE INVENTION

A sealing device for a door, and in particular for a garage door, for sealing the door and frame to facilitate the exclusion of elements, such as, for example, draughts, wind, rain, snow, insects, and the like. An improved weather strip sealing device is provided which affords a pleasing appearance, is easy to install, and can be removed and replaced when necessary.

A first part or base is mounted to a door frame in proximity to a garage door. A matingly configured second part is adapted to be connected to the first part. Preferably, the second part carries a flexible portion which is provided to engage with the garage door to maintain a seal.

An attachment mechanism is provided to connect the first part with the second part, so that the first part can be installed prior to connecting the second part with the first part. Preferably, the first part can be positioned for mounting on a door frame, and once positioned, the installer will have more than one choice of attachment locations along the first part at which to attach the first part to the frame. That is, if for example, screws or nails are used, more than one nailing (or screw) spot along the length of the first part is provided. This facilitates mounting and attachment, in particular, where a single choice of nailing would otherwise cause the location of the nail to be between two pieces of wood or another undesirable location.

A connecting mechanism is provided to facilitate the connection of the second part with the first part. Once the first part is installed on a frame, the second part, preferably, is press fit over the first part and snapped into engagement therewith. Suitable connecting elements of the first part engage with connecting elements of the second part. Similarly, the second part can be removed from the first part when necessary.

Preferably, the first part and second part are comprised of material which is resistant to whether and elements which are to be encountered, such as, for example, acid rain, cold, heat, water, and the like. The first and second parts, preferably, are also flexible so that they can be snapped together, and readily separated, if desired. An additional benefit to providing a flexible material composition is that in the unfortunate event that the sealing device is used for sealing around the perimeter of a garage door, and is accidentally hit by a car exiting or entering the garage, the second part can detach, thereby possibly minimizing further damage to the garage frame, as well as the vehicle. Similarly, if the second part is damaged, but the first part is not, a new second part can be installed on the first part.

Similarly, if a new garage door is installed, a second part can be replaced with one which is compatible with the new door. For example, if a stainable garage door is used, and the second part was painted, the painted second part can be replaced with a stainable second part, which can be stained to match the door.

An object of the present invention is to provide a novel weather strip device for sealing around the perimeter of a door.

Another object of the present invention is to provide a novel weather strip device which can be stained or painted to match existing trim or molding pieces.

Another object of the present invention is to provide a novel weather strip device which can be attached to a mounting surface with fasteners, and which when installed hides the fasteners from view.

Another object of the present invention is to provide a novel weather strip device having an appearance of wood.

Another object of the present invention is to provide a novel weather strip device which has a first part which is mountable to a mounting surface and a second part which may be snap-fit into position over the first part.

Another object of the present invention is to provide a novel weather strip device which has multiple mounting locations for facilitating attachment of the device to a mounting surface.

BRIEF DESCRIPTION OF THE DRAWING FIGURES

DETAILED DESCRIPTION OF THE PREFERRED EMBODIMENTS

Figure 1:
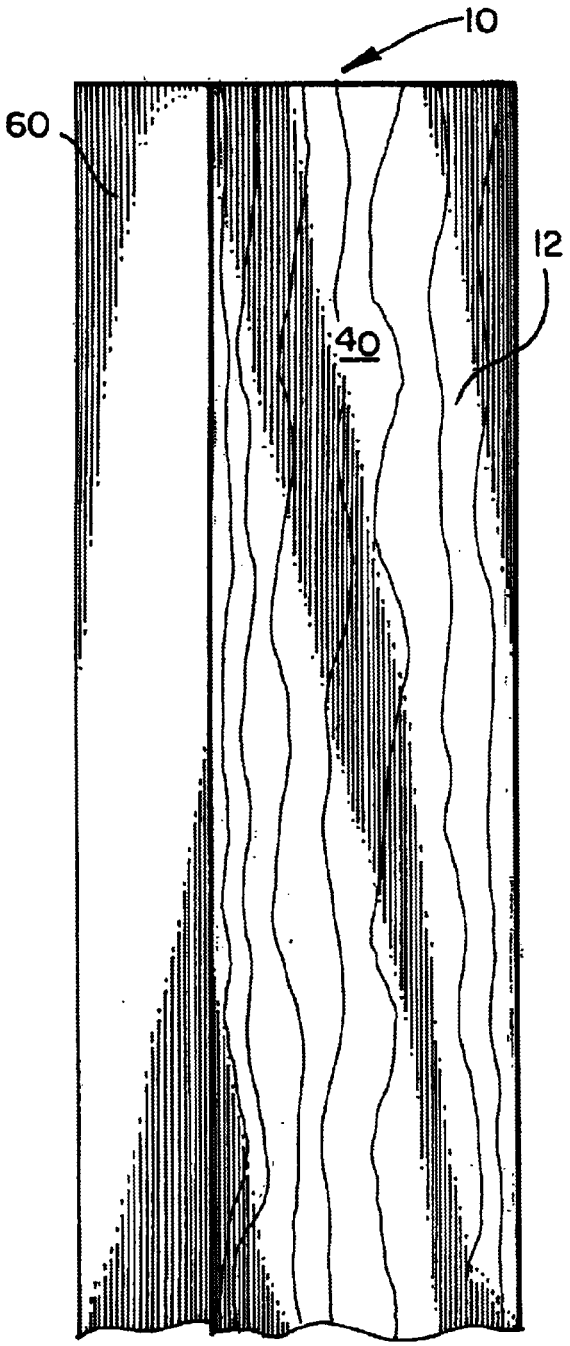
FIG. 1 is a front elevation view of a weather strip device constructed in accordance with the invention.

Referring to the drawing figures, there is illustrated a weather strip 10 constructed in accordance with the present invention. The weather strip 10 comprises a first part or base member 11 which is adapted to be mounted on a door frame and a second part 12 which is adapted to be removably connected with said base member 11. The base member 11 is illustrated best in FIG. 2 having a rear wall 13 and mounting means for attaching the base member to a mounting surface. In accordance with a preferred embodiment of the invention, the mounting means may comprise a plurality of apertures 15, 16 disposed in the base member rear wall 13. Suitable fastening members, such as screws, nails, bolts, or the like, may be used to attach the base member 11 to a supporting surface.

Figure 2:
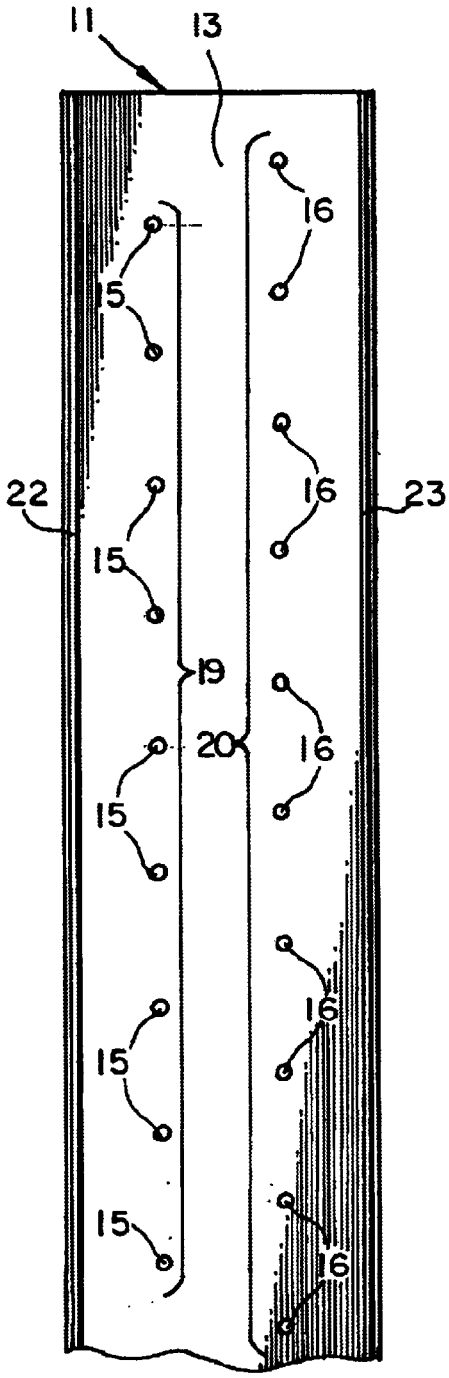
FIG. 2 is a front elevation view showing the base member of the device separately from the other components.
Figure 3:
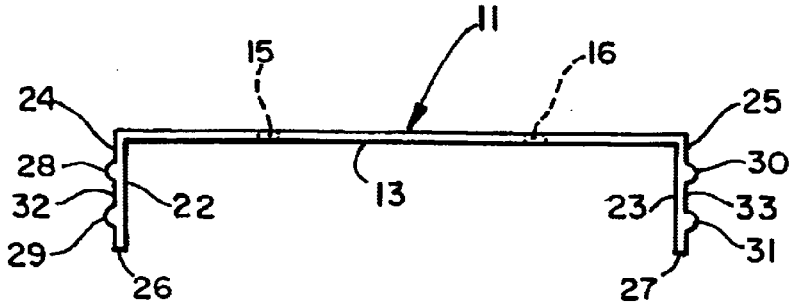
FIG. 3 is a top plan view of the base member shown in FIG. 2.
Figure 4:
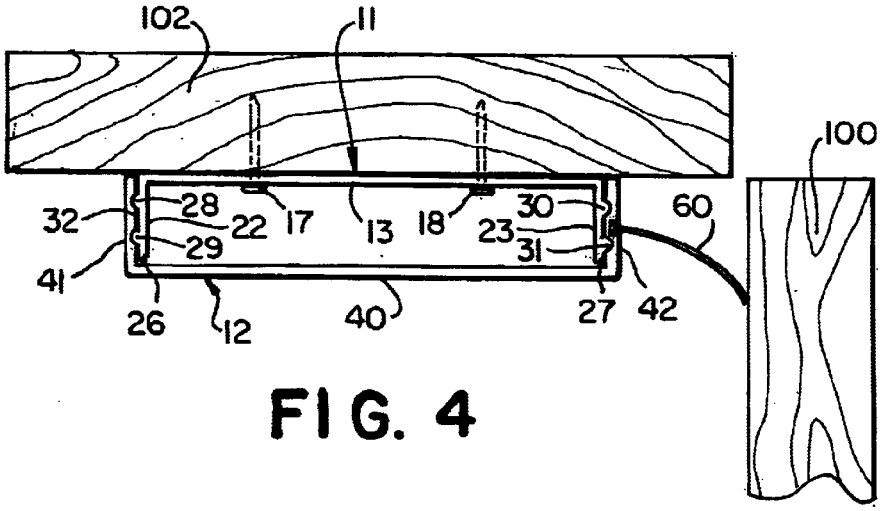
FIG. 4 is a top plan view of the weather strip device of FIG. 1 shown installed in a door frame with a garage door and a door jamb illustrating an environment of use.
Figure 5:
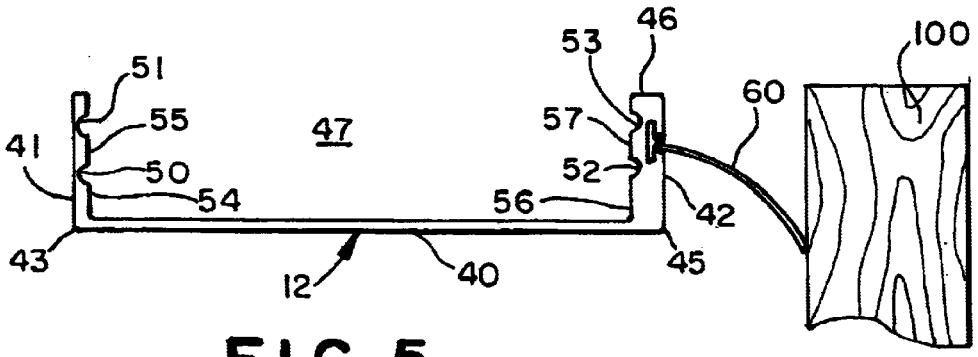
FIG. 5 is a side elevation view showing the weather strip device of FIG. 1 installed on a header of a door frame and in an environment with a garage door.

As shown in FIGS. 4 and 5, the fastening members are illustrated as nails 17, 18 which are inserted into the base member apertures, respectively 15 and 16, and are driven into the door jamb 101. The apertures 15, 16 preferably are arranged to provide at least two locations along the vertical span of the base member 11 for facilitating the attachment of the base member 11 to a door frame. Referring to FIG. 2, the apertures 15, 16 are arranged in at least two longitudinal spaced apart courses, a first course 19 being represented by those apertures designated 15, and a second course 20 being represented by those apertures designated 16. The first course 19 and second course 20 provide alternate fastening locations so that in the event that one of the fastening locations is not feasible, that is due to a wood joint, seam, knot, or other impediment, there are alternate locations at which to fasten the base member 11 to preserve its location proximate to a door, such as, for example, the garage door 100 illustrated in FIGS. 4 and 5. Alternately, while shown secured with nails 17, 18 in both courses of the apertures 15, 16, it will be understood that alternate nailing utilizing only some of the apertures 15, 16, or one of the courses 19 or 20, may be done to attach the base member 11 to a door jamb.

The second part 12 connects with the base member 11, and can be removed and replaced from the base member 11 as the user elects. Connecting means is provided for connecting the second part 12 with the base member 11. Connecting means preferably comprises a first connecting element disposed on the base member 11 which may be connected to the second part, with the first connecting element being configured for releasable securing with said second connecting element.

In accordance with the preferred embodiment, connecting means is provided for connecting the second part 12 with the base member 11. The base member 11 has a first side wall 22 and a second side wall 23 each having a first end 24, 25, respectively, which is connected to the base member rear wall 13, and a second end 26, 27, respectively which is located a predetermined distance from the rear wall 13. The side walls 22, 23 carry a first connecting means thereon for connecting with the second part 12. The first connecting means is shown comprising longitudinal ribs 28, 29 provided on the first side wall 22 and longitudinal ribs 30, 31 on the second side wall 23. A recess 32 is shown formed between the longitudinal ribs 28, 29, and a recess 33 between ribs 30, 31.

Second connecting means is provided on the second part 12 for connecting with the base member 11. As illustrated in FIGS. 4 and 5, the first connecting means and second connecting means are matingly associated with each other to secure with each other when engaged. The second part preferably is constructed having a front face 40, a first side wall 41 and a second side wall 42. The first sidewall 41 is shown having a first end 43 respectively, which is connected to the front face 40, and a second end 44 which is located a predetermined distance from the front face 40. Similarly, the second sidewall 42 is shown having a first end 45 connected to the front face 40, and a second end 46 located at a predetermined distance from the front face 40. The side walls 41, 42 form with said face 40 a substantially unshaped channel 47 which is configured to fit over the base member 11, as illustrated in FIG. 4. The second connecting means provided on the second part 12 is illustrated comprising longitudinal ribs 50, 51 disposed on the second part first side wall 41, and longitudinal ribs 52, 53 disposed on the second side wall 42. Grooves 54, 55, and 56, 57 are shown formed in connection with the ribs 50, 51, and 52, 53.

The second part 12 has a sealing element 60 which preferably is comprised of a flexible material. The sealing element 60 preferably is provided on a sidewall of the second part 12, such as the second part second side wall 42, illustrated in FIGS. 4 and 5. The sealing element 60 is disposed to engage with a door, such as for example, the garage door 100 shown in FIGS. 4, 5 and 6. Preferably, the sealing element 60 is constructed from a flexible material which can withstand extreme weather conditions, and temperature changes. The base member 11 is installed on the door jamb 102 proximate the door 100 so that when the second part 12 is connected to the base member 11, the sealing element 60 preferably engages the door 100.

While shown carried by the second part 12, the sealing element 60, alternately, may be carried by the base member 11, although not illustrated.

The weather strip 10 is installed by aligning the base member 11 along the door jamb 102 and mounting the base member 11 to the door jamb 102 with a fastening member. The second part 12 is connected, preferably by press-fit, or snapping into position over, the base member 11. It is preferred that the second part 12 have side walls which are flexible so that the sidewalls 41, 42 can be flexed to fit over the sidewalls 22, 23, respectively of the base member 11 to align the grooves 32, 33 of the base member 11 with the respective corresponding ribs 50, 51 and 52, 53 of the second part 12, as shown in FIG. 4.

Preferably, the second part 12 is constructed to comprise a living spring with the first wall 41 and second wall 42 being provided as spring members. In addition, the face 40 of the second part 12 can also be provided as a living spring to work with the first wall 41 and second wall 42. The walls 41 and 42 are biased to a rest position shown in FIG. 5. When the second part 12 is installed on the first part 11 by positioning it over the first part 11 and pressing it thereon, the walls 41 and 42 engage the walls 22, 23 of the base member 11 and are moved outwardly, and upon being aligned for connection, as shown in FIG. 4, the natural bias of the living spring holds the second part 12 on the first member 11.

It will be understood that while the living spring is described in relation to the second part 12, the base member 11 can also be constructed as a living spring. Alternately, one or the other, or both, the base member 11 and the second part 12 can be constructed as a living spring.

Figure 6:
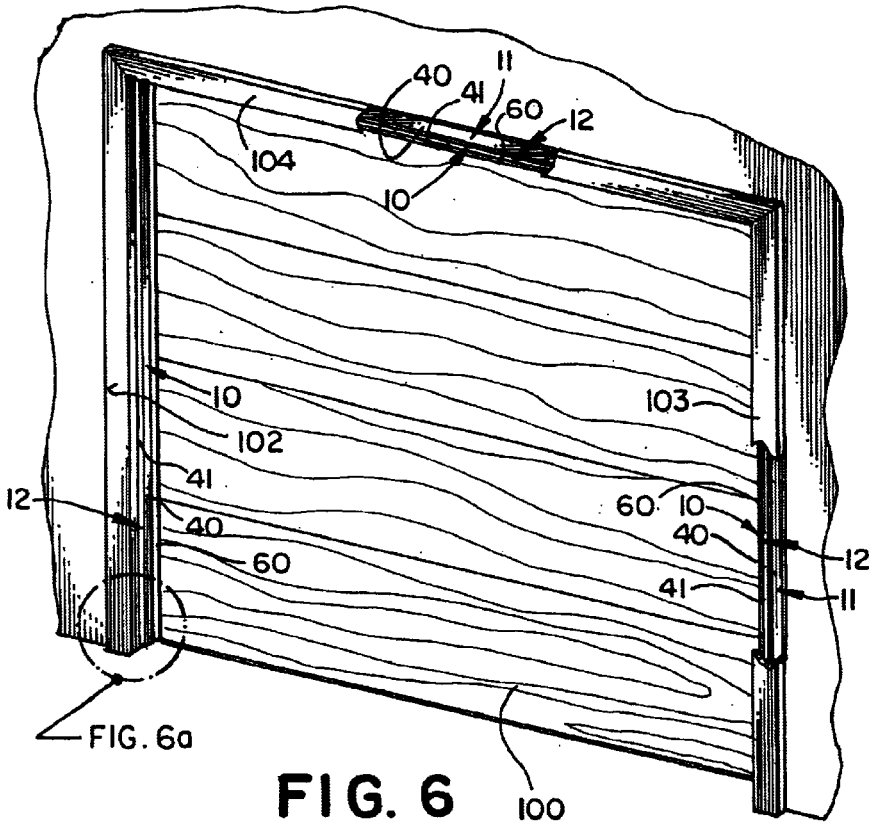
FIG. 6 is a front perspective view showing a garage door installed in a frame with the weather strip device of FIG. 1 installed around the perimeter of the door.
Figure 6A:
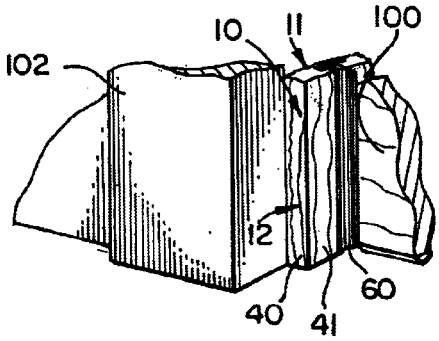

Preferably, as shown, the mounting surface may comprise a door frame, header, jamb, wall or other surface surrounding a door panel. Referring to FIG. 6, a door entry way 105 is illustrated in connection with a garage door 100, and is surrounded by a left side door jamb 102, a right side door jamb 103 and a header 104. The weather strip 10 is preferably attached to each the left side door jamb 102, the right side door jamb 103, and the header 104 in order to provide a seal with the door 100. For purposes of illustrating the invention, the weather strip 10 is shown in FIGS. 4 and 5 installed in connection with a garage door 100.

The second part 12 may be removed as desired by the user. For example, if during use the second part 12 should become damaged, then the base member 11 can remain installed, and the second part 12 removed and replaced with a new or an undamaged second part.

Preferably, the base member 11 is comprised of a material which is strong and resistant to extreme weather conditions, as well as changes in weather conditions. Suitable materials include aluminum, plastic, vinyl and fiberglass. Similarly the second part 12 is likewise configured from a material which is strong, resistant to extreme weather conditions, as well as changes in weather conditions, and which can include such materials, for example, as aluminum, plastic, vinyl and fiberglass.

In accordance with a preferred embodiment of the invention, the second part 12 can comprise a stainable, paintable material, such as fiberglass. This facilitates matching of the weather strip 10 appearance with the garage door 100, trim, or other surrounding elements.

Although shown with two ribs 28, 29, it will be understood that a single rib, or multiple ribs may be employed consistent with the principles of the invention disclosed herein. Alternately, or in addition thereto, it will be understood that the ribs, while disclosed as being longitudinally provided over the length of the base member 11 can be provided as segments which are non-continuous over the length of the base member 11.

The weather strip 10 can be provided in different finishes so that the user may select a particular finish to match or coordinate with the surrounding structure, such as door trim, door panels, and the like. For example, the weather strip may be gray to match gray siding on a house or may be a stained fiberglass to match a redwood door. These and other colors and finishes may be utilized in connection with the weather strip invention.

What is claimed is:

1. A sealing device for a door comprising:

(a) a first part adapted to be mounted on a door frame;

(b) a second part adapted to be removably connected to said first part;

(c) connecting means for connecting said first part and said second part;

(d) mounting means for mounting said first part to a frame of a structure;

(e) wherein said first part is mounted with mounting means to the door frame;

(f) wherein said mounting means comprises a plurality of apertures disposed in said first part, said apertures being arranged to provide at least two locations for attaching the first part to the door frame;

(g) wherein said connecting means comprises at least one first connecting element disposed on said first part and at least one second connecting element disposed on said second part, wherein said first connecting element is configured for releasable securing with said second connecting element;

(h) wherein said first part is an elongate member having a mounting surface and pair of spaced apart sidewalls, each sidewall having a first end which is connected to said mounting surface and protruding outwardly from said mounting surface and forming a substantially u-shaped channel;

(i) a flexible sealing member carried by said second part which is adapted for engagement with the door, said second member having a face with a pair of sidewalls, each second part sidewall being connected to the face and forming with said face a substantially u-shaped channel, wherein said connecting means further comprises a second connecting element provided on each second part sidewall, wherein said first connecting element is matingly configured to connect with said second connecting element to sec ore the second part on said first part;

(j) wherein said second part sidewalls are configured to overlap said first part sidewalls.

2. A sealing device for a door comprising:

(a) a first part adapted to be mounted on a door frame;

(b) a second part adapted to be removably connected to said first part;

(c) connecting means for connecting said first part and said second part;

(d) mounting means for mounting said first part to a frame of a structure;

(e) a sealing member which is carried on at least one of the first part and one of the second part;

(f) wherein said first part is mounted with mounting means to the door frame; and (g) wherein said connecting means comprises one of a longitudinal rib and a longitudinal recess disposed along the first part and the other of said longitudinal rib and said longitudinal recess disposed along the second part, wherein said longitudinal rib and said longitudinal recess are adapted to releasably engage each other to connect said second part with said first part.

3. The device of claim 2, wherein said first part is an elongate member having a mounting surface and pair of spaced apart sidewalls, each sidewall having a first end which is connected to said mounting surface and protruding outwardly from said mounting surface.

4. The device of claim 2, wherein said second part comprises a material which can be painted or stained.

5. The device of claim 2, wherein said second part is comprised of a fiberglass material.

6. The device of claim 2, wherein said second part is provided with a surface simulating woodgrain.

7. The device of claim 2, wherein at least one of the first part or the second part comprises a living spring.

8. A sealing device for a door comprising:

(a) a first part adapted to be mounted on a door frame;

(b) a second part adapted to be removably connected to said first part;

(c) connecting means for connecting said first part and said second part;

(d) mounting means for mounting said first part to a frame of a structure;

(e) a sealing member which is carried on at least one of the first part and one of the second part;

(f) wherein said first part is mounted with mounting means to the door frame; and (g) wherein said first part comprises a base with a pair of sidewalls, each first part sidewall being connected to the base and forming with said base a substantially u-shaped channel, wherein said connecting means comprises a first connecting element provided on each first part sidewall, wherein said second part carries a flexible sealing member adapted for engagement with the door, said second member having a face with a pair of sidewalls, each second part sidewall being connected to the face and forming with said face a substantially u-shaped channel, wherein said connecting means further comprises a second connecting element provided on each second part sidewall, wherein said first connecting element is matingly configured to connect with said second connecting element to secure the second part on said first part.

9. The device of claim 8, wherein said second part sidewalls are configured to overlap said first part sidewalls.

10. The device of claim 9, wherein said second part sidewalls are provided having a height substantially the same as the height of said first part sidewalls.

11. A sealing device for a door comprising:

(a) a first part adapted to be mounted on a door frame;

(b) a second part adapted to be removably connected to said first part;

(c) connecting means for connecting said first part and said second part;

(d) mounting means for mounting said first part to a frame of a structure;

(e) a sealing member which is carried on at least one of the first part and one of the second part;

(f) wherein said first part is mounted with mounting means to the door frame; and (g) wherein said first part has a rear wall, a sidewall having a first end connected to said rear wall, and a second sidewall having a first end connected to said rear wall, and wherein said second part has a face, a first sidewall having a first end connected to said face, and a second sidewall having a first end connected to said face, wherein at least one of said first part first sidewall, said first part second sidewall, said second part first sidewall and said second part second sidewall comprises a living spring.

12. The device of claim 11, wherein said mounting means comprises a plurality of apertures disposed in said first part, said apertures being arranged to provide at least two locations for attaching the first part to a the door frame.

13. The device of claim 11, wherein said mounting means comprises a plurality of apertures formed in said first part, said apertures being arranged in at least two longitudinal spaced apart courses.

14. The device of claim 11, wherein said connecting means comprises at least one first connecting element disposed on said first part and at least one second connecting element disposed on said second part, wherein said first connecting element is configured for releasable securing with said second connecting element.

15. The device of claim 11, wherein said connecting means comprises a connecting portion provided on said first part, and a matingly associated connecting portion provided on said second part.

16. The device of claim 15, wherein said connecting portion of the first part is configured to connect with the connecting portion of the second part.

* * * * *

UNITED STATES PATENT AND TRADEMARK OFFICE

CERTIFICATE OF CORRECTION

PATENT NO. : 6,772,560 B2
DATED : August 10, 2004
INVENTOR(S) : Dischinat et al.

It is certified that error appears in the above-identified patent and that said Letters Patent is hereby corrected as shown below:

Title page,
Item [76], Inventor, delete "Dischiant" and replace with -- Dischinat --; and delete "Stomy" and replace with -- Stony --

Column 6,
Line 41, delete "sec ore" and replace with -- secure --

Signed and Sealed this

Thirtieth Day of November, 2004

JON W. DUDAS
*Director of the United States Patent and Trademark Office*